US006085531A

United States Patent [19]

Numoto et al.

[11] Patent Number: 6,085,531

[45] Date of Patent: Jul. 11, 2000

[54] AIR CONDITIONER

[75] Inventors: Hironao Numoto, Shiga; Jiro Suzuki, Nara; Akira Fujitaka, Shiga, all of Japan

[73] Assignee: Matsushita Electric Industrial Co., Ltd., Osaka, Japan

[21] Appl. No.: 09/280,688

[22] Filed: Mar. 30, 1999

[30] Foreign Application Priority Data

Apr. 23, 1998 [JP] Japan ..... 10-113150

[51] Int. Cl.[7] ..... F25B 45/00

[52] U.S. Cl. ..... 62/149; 62/129

[58] Field of Search ..... 62/149, 129, 125, 62/126

[56] References Cited

U.S. PATENT DOCUMENTS

| | | | |
|---|---|---|---|
| 4,711,096 | 12/1987 | Krantz | 62/129 |
| 5,551,247 | 9/1996 | Manz et al. | 62/149 |
| 5,660,051 | 8/1997 | Sakakibara et al. | 62/133 |
| 5,694,779 | 12/1997 | Matsushima et al. | 62/114 |
| 5,918,475 | 7/1999 | Sakakibara et al. | 62/186 |

*Primary Examiner*—Henry Bennett

*Assistant Examiner*—Marc Norman

*Attorney, Agent, or Firm*—Armstrong, Westerman, Hattori, McLeland & Naughton

[57] ABSTRACT

In a refrigeration cycle using a flammable refrigerant as a refrigerant and comprising an indoor heat exchanger, an outdoor heat exchanger, a compressor and an expansion device which are annularly connected to one another through pipes, the refrigeration cycle is provided with a gas sensor and a refrigerant discharge portion, the gas sensor monitors leakage of the refrigerant from the refrigeration cycle to outside, and after the leakage is detected by the gas sensor, the discharge portion is opened to discharge the refrigerant to outside. At that time, the gas sensor is disposed inside a room, and the discharge portion is disposed outside the room. Further, the discharge portion is provided with a fan to facilitate the dispersion of the refrigerant. Further, the discharge portion is provided with a burner portion to discharge out the refrigerant while burning the refrigerant. With the above structure, the leakage of a flammable refrigerant is monitored, and after the leakage is detected, the refrigerant is positively discharged to the safe atmosphere, e.g., to the side of an outdoor unit, and even if the refrigerant is leaked at the side of an indoor unit, it is possible to suppress the leakage to a certain level.

15 Claims, 4 Drawing Sheets

AIR CONDITIONER

TECHNICAL FIELD

The present invention relates to a safety measure for an air conditioner comprising a refrigeration cycle using a flammable refrigerant such as propane (R290), isobutane (R600a), ethane (R170) and the like.

BACKGROUND TECHNIQUE

At present, Freon-based refrigerants that have stable properties and are easy to be handled are used as refrigerants of an apparatus having a refrigeration cycle such as a freezer, a refrigerator and an air conditioner. However, although the Freon refrigerants have stable properties and are easy to be handled, it is said that the Freon refrigerants destroy the ozone layer, and since the Freon refrigerants adversely affect the global environment, the use of the Freon refrigerants will be entirely prohibited in the future after a preparatory period of time.

Among the Freon-based refrigerants, hydro fluorocarbon (HFC) refrigerants do not seem to destroy the ozone layer, but they have properties to facilitate the global warming. Especially in Europe where the people is concerned about environmental problems, there is a tendency to prohibit the use of this refrigerant also. That is, there is a tendency that the use of the Freon refrigerants that are artificially produced is prohibited, and natural refrigerants such as hydrocarbon are used as in the past.

However, since such natural refrigerants are flammable, it is necessary to prevent the explosion or ignition of the refrigerants for safety.

As a method for preventing the explosion or ignition when hydrocarbon refrigerant is used, it is proposed to remove, isolate or keep away from a fire source (e.g., Japanese Patent Applications Laid-open No.H7-55267 and No.H8-61702). For preventing the explosion or ignition of the hydrocarbon refrigerant, it is also proposed to convert the refrigerant into a non-flammable refrigerant (e.g., Japanese Patent Application Laid-open No.H9-59609).

However, although it is effective, for safety of the air conditioner, to remove, isolate or keep away from the fire source, it can not be said that this is a fundamental solution. Further, it is extremely difficult to convert the refrigerant into the non-flammable refrigerant, and a conclusive method has not yet been proposed.

To solve the above problem, according to the present invention, there is proposed an air conditioner using a flammable refrigerant, in which a gas sensor monitors leakage of the refrigerant out of the air conditioner, and if the leakage is detected by the gas sensor, the refrigerant in a refrigeration cycle is positively discharged from a discharge portion to outside to the atmosphere, thereby removing the refrigerant charged in the refrigeration cycle.

With the above structure, the leakage of a flammable refrigerant is monitored, and after the leakage is detected, the refrigerant is positively discharged to the safe atmosphere, e.g., to the side of an outdoor unit, and even if the refrigerant is leaked at the side of an indoor unit, it is possible to suppress the leakage to a certain level.

DISCLOSURE OF THE INVENTION

To achieve the above object, according to a first aspect, there is provided an integral-type air conditioner, in which an indoor unit and an outdoor unit are formed integrally, a refrigeration cycle comprises an indoor heat exchanger, an outdoor heat exchanger, a compressor, and an expansion device which are annularly connected to one another through pipes, and the refrigeration cycle uses a flammable refrigerant as a refrigerant, wherein a gas sensor is provided inside a room, a refrigerant discharge portion is disposed outside the room, the gas sensor monitors leakage of the refrigerant from the refrigeration cycle toward outside, after the leakage is detected by the gas sensor, the discharge portion is opened to discharge the refrigerant outside. With this feature, since the refrigerant charged in the refrigeration cycle is discharged from the refrigeration cycle whose airtight capacity becomes incomplete to the atmosphere toward a safe place, it is possible to prevent the refrigerant from being accumulated in a dangerous place, such as a place where the leaked refrigerant tends to stay so that there is a possibility of explosion or ignition.

According to a second aspect, there is provided a separation type air conditioner, in which a refrigeration cycle comprises an indoor heat exchanger included in an indoor unit, an outdoor heat exchanger included in an outdoor unit, a compressor, and an expansion device which are annularly connected to one another through pipes, the refrigeration cycle uses a flammable refrigerant as a refrigerant, and the indoor unit and the outdoor unit are connected with each other using connection pipes, wherein the refrigeration cycle is provided with a gas sensor and a refrigerant discharge portion, the gas sensor monitors leakage of the refrigerant from the refrigeration cycle toward outside, after the leakage is detected by the gas sensor, the discharge portion is opened to discharge the refrigerant outside. With this feature, the refrigerant charged in the refrigeration cycle is discharged from the refrigeration cycle whose airtight capacity becomes incomplete to the atmosphere toward a safe place. Therefore, even in the separation type air conditioner generally having a large amount of refrigerant, it is possible to prevent the refrigerant from being accumulated in a dangerous place, such as a place where the leaked refrigerant tends to stay so that there is a possibility of explosion or ignition.

According to a third aspect, in the second aspect, the indoor unit is provided with the gas sensor, and the outdoor unit or the connection pipes are provided with the refrigerant discharge portion. With this feature, it is possible to prevent the refrigerant from staying in a closed space, which is most dangerous for the flammable refrigerant. That is, it is possible to prevent a case in which the flammable refrigerant leaks from the indoor unit, such a leaked refrigerant stays in a place having poor ventilation, and explosion or ignition is caused. By disposing the discharge portion in the safe outdoor unit or the safe connection pipes, it is possible to swiftly discharge the refrigerant safely. That is, by disposing the discharge portion in a place having good ventilation, the flammable refrigerant is sufficiently mixed with the atmosphere and dispersed.

According to a fourth aspect, there is provided an integral-type air conditioner, in which an indoor unit and an outdoor unit are formed integrally, a refrigeration cycle comprises an indoor heat exchanger, an outdoor heat exchanger, a compressor, and an expansion device which are annularly connected to one another through pipes, and the refrigeration cycle uses a flammable refrigerant as a refrigerant, wherein a gas sensor is provided inside a room, a refrigerant discharge portion and a fan are disposed outside the room, the gas sensor monitors leakage of the refrigerant from the refrigeration cycle toward outside, after the leakage is detected by the gas sensor, the discharge portion is opened to discharge the refrigerant outside while rotating the fan. With this feature, since the refrigerant discharged from the discharge portion to the atmosphere is stirred with the fan, the flammable refrigerant can be discharged to the atmosphere more safely.

According to a fifth aspect, there is provided a separation type air conditioner, in which a refrigeration cycle comprises an indoor heat exchanger included in an indoor unit, an outdoor heat exchanger included in an outdoor unit, a compressor, and an expansion device which are annularly connected to one another through pipes, the refrigeration cycle uses a flammable refrigerant as a refrigerant, and the indoor unit and the outdoor unit are connected with each other using connection pipes, wherein a gas sensor, a refrigerant discharge portion and a fan are disposed in the refrigeration cycle, the gas sensor monitors leakage of the refrigerant from the refrigeration cycle toward outside, after the leakage is detected by the gas sensor, the discharge portion is opened to discharge the refrigerant outside while rotating the fan. With this feature, since the refrigerant discharged from the discharge portion to the atmosphere and the leaked refrigerant are stirred with the fan, the flammable refrigerant can be discharged to the atmosphere more safely even in the separation type air conditioner generally having a large amount of refrigerant.

According to a six aspect, in the fifth aspect, said indoor unit is provided with said gas sensor, and said outdoor unit or the connection pipes are provided with said refrigerant discharge portion and said fan. With this feature, it is possible to prevent a case in which the flammable refrigerant leaks from the indoor unit, such a leaked refrigerant stays in a place having poor ventilation, and explosion or ignition is caused. By disposing the discharge portion and the fan in the safe outdoor unit or the safe connection pipes, it is possible to swiftly discharge the refrigerant safely.

According to a seventh aspect, there is provided an integral-type air conditioner, in which an indoor unit and an outdoor unit are formed integrally, a refrigeration cycle comprises an indoor heat exchanger, an outdoor heat exchanger, a compressor, and an expansion device which are annularly connected to one another through pipes, and the refrigeration cycle uses a flammable refrigerant as a refrigerant, wherein a gas sensor is provided inside a room, a refrigerant discharge portion and a burner portion are disposed outside the room, the gas sensor monitors leakage of the refrigerant from the refrigeration cycle toward outside, after the leakage is detected by the gas sensor, the discharge portion is opened to discharge the refrigerant outside while burning the refrigerant. With this feature, since refrigerant drawn from the refrigeration cycle can be forcibly burnt, even if a portion of the drawn refrigerant stays, it is possible to prevent the explosion or ignition.

According to an eighth aspect, there is provided a separation type air conditioner, in which a refrigeration cycle comprises an indoor heat exchanger included in an indoor unit, an outdoor heat exchanger included in an outdoor unit, a compressor, and an expansion device which are annularly connected to one another through pipes, the refrigeration cycle uses a flammable refrigerant as a refrigerant, and the indoor unit and the outdoor unit are connected with each other using connection pipes, wherein the refrigeration cycle is provided with a gas sensor, a refrigerant discharge portion and a burner portion, the gas sensor monitors leakage of the refrigerant from the refrigeration cycle toward outside, after the leakage is detected by the gas sensor, the discharge portion is opened to discharge the refrigerant outside while burning the refrigerant. With this feature, since refrigerant drawn from the refrigeration cycle can be forcibly burnt, even if a portion of the drawn refrigerant stays, it is possible to prevent the explosion or ignition, even in the separation type air conditioner generally having a large amount of refrigerant.

According to a ninth aspect, in the eighth aspect, the indoor unit is provided with the gas sensor, and said outdoor unit or the connection pipes are provided with said refrigerant discharge portion and said burner portion. With this feature, it is possible to prevent a case in which the flammable refrigerant leaks from the indoor unit, such a leaked refrigerant stays in a place having poor ventilation, and explosion or ignition is caused. By disposing the discharge portion and the burner portion in the safe outdoor unit or the safe connection pipes, it is possible to swiftly discharge the refrigerant safely.

According to a tenth aspect, in the seventh or ninth aspect, the flammable refrigerant in the refrigeration cycle and a portion of outside air are previously mixed by the burner portion. This system is generally called Bunsen burner. With this feature, since the atmosphere can uniformly sucked and mixed in accordance with the supply speed of the refrigerant which is the fuel, it is possible to burn the refrigerant more safely.

According to an eleventh aspect, in the seventh or ninth aspect, the flammable refrigerant is burnt by the burner portion in a catalyst combustion manner. Since the catalyst combustion is of a contact combustion type, a degree of safety is high, and the fire hardly goes out unlike the flame combustion. Therefore, the refrigerant can be discharged to atmosphere safely. Further, since the combustion load per space can be great, the burner portion can be formed compactly.

According to a twelfth aspect, in any one of the first to ninth aspects, the flammable refrigerant comprising, as main component, one of propane, isobutane and ethane, or a mixture of a plurality of these components. Among the flammable refrigerants, hydro fluorocarbon (HFC) based refrigerant has a problem of warming and thus, such a refrigerant should not be discharged. If the refrigerant is a natural refrigerant such as propane, isobutane or ethane, even if the refrigerant is discharged to the atmosphere, since a warming coefficient is small, this does not cause a large problem. Further, if the refrigerant is burnt when the refrigerant is drown from the refrigeration cycle, since the refrigerant becomes carbon dioxide and water, there is no problem.

According to a thirteenth aspect, in any one of the first to ninth aspects, a refrigerating machine oil in the compressor has less mutual solubility with the flammable refrigerant. With this feature, since the mutual solubility between the refrigerant and the refrigerating machine oil is small, if the refrigerant is drawn from the refrigeration cycle, almost no refrigerant remains in the refrigeration cycle, it is possible to prevent permanent leakage from the leaking portion thereafter, and safety can be ensured.

According to a fourteenth aspect, in any one of the first to ninth aspects, the compressor is an oil-free compressor into which a refrigerating machine oil is not charged. With this feature, if the refrigerant is drawn from the refrigeration cycle, almost no refrigerant remains in the refrigeration cycle, it is possible to prevent permanent leakage from the leaking portion thereafter, and safety can be ensured.

According to a fifteenth aspect, in any one of the first to ninth aspects, the gas sensor is disposed between a ventilation fan and a transfer grille in an indoor unit ventilation circuit. Since propane and isobutane which are the flammable refrigerant are greater in density than air, if the refrigerant leaks from the refrigeration cycle, the refrigerant is dispersed downward. Therefore, by disposing the gas sensor between the ventilation fan and the transfer grille of the indoor unit ventilation circuit, it is possible to sufficiently detect the refrigerant leakage in the indoor space which is most dangerous.

BEST MODE FOR CARRYING OUT THE INVENTION

Embodiments of the present invention will be explained in detail with reference to the accompanying drawings.

(First Embodiment)

Figure 1:
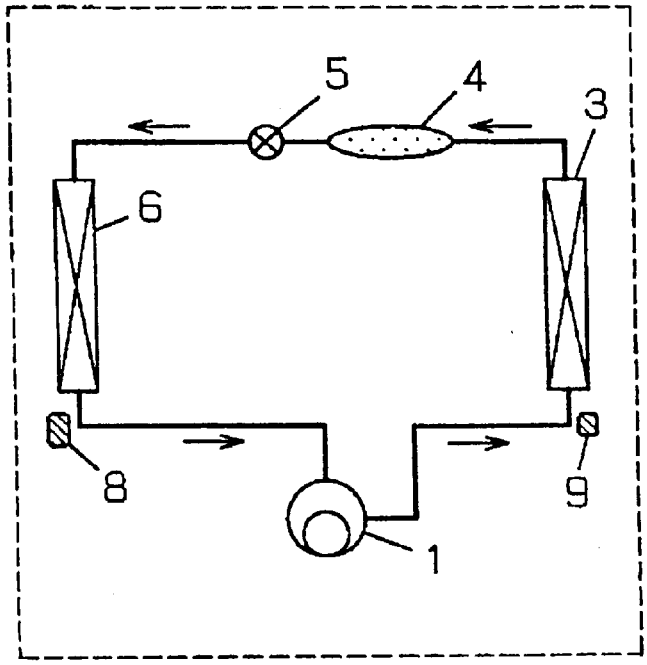
FIG. 1 is block diagram of a refrigeration cycle according to a first embodiment of the present invention.

FIG. 1 shows a refrigeration cycle in the first embodiment. The reference number 1 represents a compressor, 3 represents an outdoor heat exchanger, 4 represent a dryer, 5 represent an expansion device, and 6 represent an indoor heat exchanger. The compressor 1, the outdoor heat exchanger 3, the dryer 4, the expansion device 5, and the indoor heat exchanger 6 are built into in an integral-type air conditioner. The reference number 8 represents a gas sensor, and 9 represents a discharge electric valve. The gas sensor 8 is disposed inside a room, and the discharge electric valve 9 is disposed outside the room. 150 g of propane is used as a refrigerant, and carbonate compound is charged in the compressor 1 as a refrigerating machine oil. As the carbonate compound, carbonate compound of 99.5% of purity represented by the chemical formula 1 and having ratio of 28% carbon forming carbonic acid ester bond was used. The dryer 4 mainly comprises K-exchange A-type zeolite, and a clay which was calcined as bonding material is incorporated in the dryer 4.

Chemical formula 1:

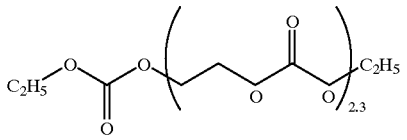

The air conditioner has the following cycle. That is, heat of the refrigerant compressed by the compressor 1 is released in the outdoor heat exchanger 3, the refrigerant is liquefied, and the refrigerant passes through the dryer 4 and the expansion device 5, thereby becoming a low-temperature gas/liquid mixture refrigerant, the refrigerant absorbs heat and vaporizes in the indoor heat exchanger 6, and is supplied to the compressor 1.

The gas sensor 8 monitors the leakage of propane, and if the gas sensor 8 detects the leakage, the gas sensor 8 immediately sends a signal to the discharge electric valve 9 which is for discharging the refrigerant, and the discharge electric valve 9 is opened, thereby discharging the propane within the refrigeration cycle into the atmosphere.

Although the gas sensor is disposed in a room in the present embodiment, the present invention is not limited to this. It is also effective to dispose the gas sensor outside the room. The gas sensor may not be disposed only in place, and when it seems that a degree of danger is high, a plurality of gas sensors can be disposed.

The gas sensor which can be used in the present invention is not specially limited to a semiconductor type and a contact combustion type, and any sensor may be used if it is a gas sensor for hydrocarbon having a high sensitivity. Any method for detection may be used. For example, a leakage signal may be sent when a peak concentration exceeds a predetermined value, or concentration of the leakage is integrated and when the amount of the leakage exceeds a predetermined value, the leakage signal may be sent.

(Second Embodiment)

Figure 2:
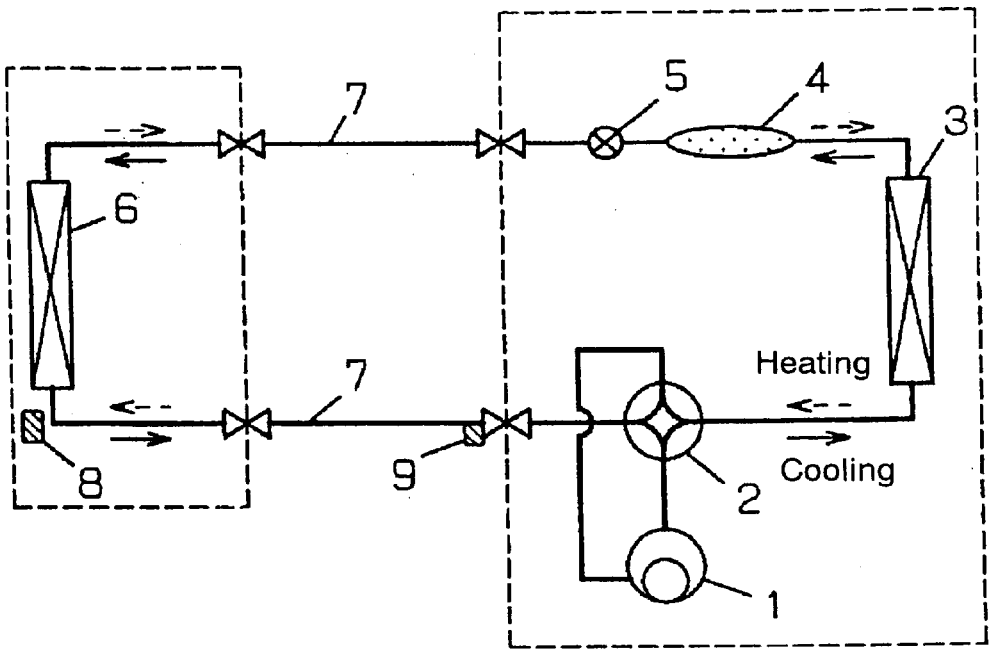
FIG. 2 is block diagram of a refrigeration cycle according to a second embodiment of the invention.

FIG. 2 shown a refrigeration cycle of a second embodiment. The reference number 1 represents a compressor, 2 represents a 4-way valve, 3 represents an outdoor heat exchanger, 4 represent a dryer, 5 represent an expansion device, 6 represent an indoor heat exchanger, and 7 represents indoor-outdoor connection pipes. The compressor 1, the 4-way valve 2, the outdoor heat exchanger 3, the dryer 4, and the expansion device 5 are built into in an outdoor unit. The reference number 8 represents a gas sensor, and 9 represents a discharge electric valve. The gas sensor 8 is disposed in an indoor unit, and the discharge electric valve 9 is disposed in a connection portion between the outdoor unit and the indoor-outdoor connection pipe 7. 250 g of propane is used as a refrigerant, and carbonate compound is charged in the compressor as a refrigerating machine oil. The same dryer as in the first embodiment was used.

At the time of the cooling operation of the air conditioner, heat of the refrigerant compressed by the compressor 1 is released in the outdoor heat exchanger 3, the refrigerant is liquefied, and the refrigerant passes through the dryer 4 and the expansion device 5, thereby becoming a low-temperature gas/liquid mixture refrigerant, the refrigerant absorbs heat and vaporizes in the indoor heat exchanger 6, and is again transferred to the outdoor unit and supplied to the compressor 1. At the time of heating operation, the flow path is switched by the 4-way valve, the refrigerant is compressed in the indoor heat exchanger 6 and is evaporated in the outdoor heat exchanger 3.

The gas sensor 8 monitors the leakage of propane, and if the gas sensor 8 detects the leakage, the gas sensor 8 immediately sends a signal to the discharge electric valve 9 which is for discharging the refrigerant, and the discharge electric valve 9 is opened, thereby discharging the propane within the refrigeration cycle into the atmosphere. In the case of a separation-type air conditioner, in generally, the amount of refrigerant is greater than that of the integral-type air conditioner due to the connection pipes. However, since the refrigerant is discharged to the high safety atmosphere, it is possible to improve safety.

Although the indoor unit is provided with the gas sensor in the present embodiment, the present invention is not limited to this. It is also effective to dispose the gas sensor in the outdoor unit. When the indoor-outdoor connection pipes are pipes built into a building, it is effective for improving safety to dispose the gas sensor in the pipe. The gas sensor may not be disposed only in place, and when it seems that a degree of danger is high, a plurality of gas sensors can be disposed.

The gas sensor which can be used in the present invention is not specially limited to a semiconductor type and a contact combustion type, any sensor may be used if it is a gas sensor for hydrocarbon having a high sensitivity. Any method for detection may be used. For example, a leakage signal may be sent when a peak concentration exceeds a predetermined value, or concentration of the leakage is integrated and when the amount of the leakage exceeds a predetermined value, the leakage signal may be sent.

(Third Embodiment)

Figure 3:
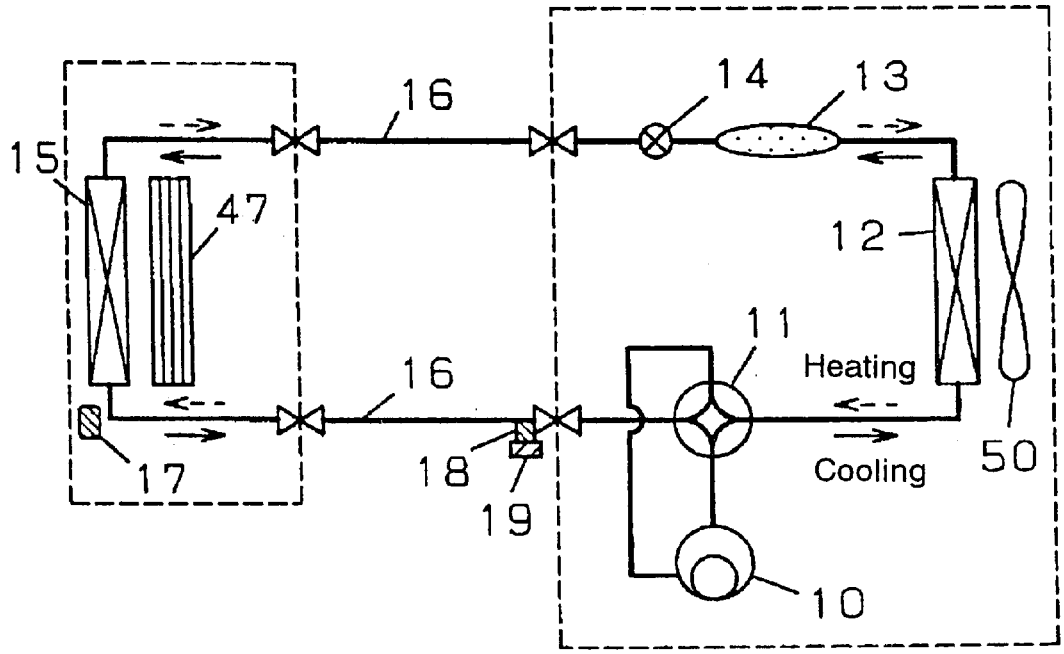
FIG. 3 is block diagram of a refrigeration cycle according to a third embodiment of the invention.

FIG. 3 shows a refrigeration cycle of a third embodiment. The reference number 10 represents a compressor, 11 represents a 4-way valve, 12 represents a outdoor heat exchanger, 13 represents a dryer, 14 represents an expansion device, 15 represents an indoor heat exchanger, and 16 represents indoor-outdoor connection pipes. The compressor 10, the 4-way valve 11, the outdoor heat exchanger 12, the dryer 13, and the expansion device 14 are built in an outdoor unit. The reference number 17 represents a gas sensor, 18 represents a discharge electric valve, 19 represents a fan, 47 represents an indoor fan, and 50 represents an outdoor fan. The gas sensor 17 is disposed in an indoor unit, and the discharge electric valve 18 is disposed in a connection portion between the outdoor unit and the indoor-outdoor connection pipe 16. The fan 19 is disposed adjacent to the discharge electric valve 18. As in the first embodiment, propane is used as a refrigerant, and carbonate compound is charged in the compressor 10 as a refrigerating machine oil. The same dryer as in the first embodiment was used.

The present embodiment has the structure in which the fan 19 is added to the first embodiment, and with this structure, propane discharged from the discharge electric valve 18 to the atmosphere while dispersing the propane by the fan 19. Therefore, the propane can be discharged to the atmosphere more safely. Further, since the indoor fan and the outdoor fan are operated at the same time to disperse the leaked refrigerant, safety is further improved.

Although the indoor unit is provided with the gas sensor in the present embodiment, the present invention is not limited to this. It is also effective to dispose the gas sensor in the outdoor unit. When the indoor-outdoor connection pipes are pipes built into a building, it is effective for improving safety to dispose the gas sensor in the pipe. The gas sensor may not be disposed only in place, and when it seems that a degree of danger is high, a plurality of gas sensors can be disposed.

As the fan used in the present invention, various fans such as a sirocco fan and a propeller fan can be used, and the fan may have any type if it has the function to stir the discharged refrigerant with blades.

(Fourth Embodiment)

Figure 4:
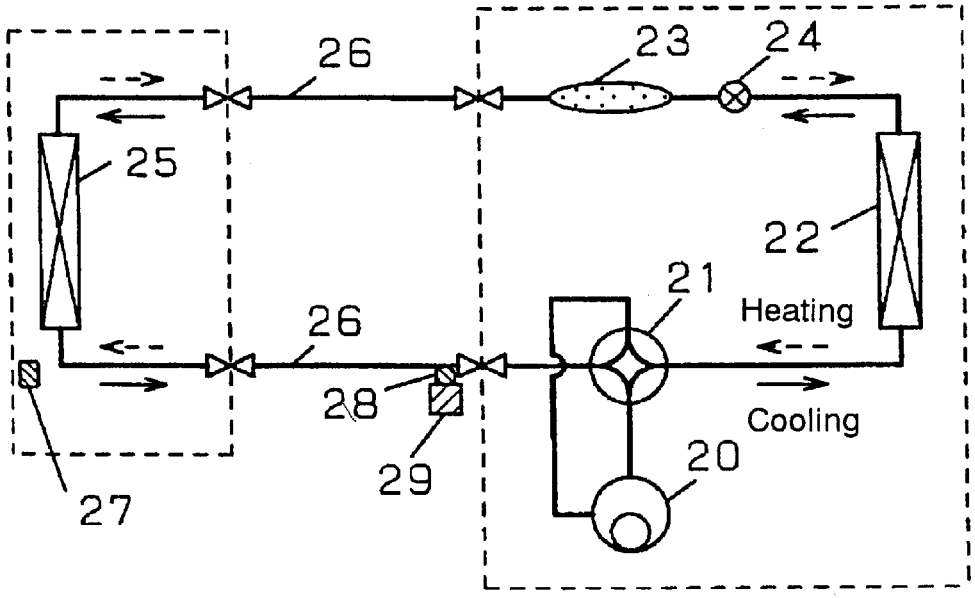
FIG. 4 is block diagram of a refrigeration cycle according to a fourth embodiment of the invention.
Figure 5:
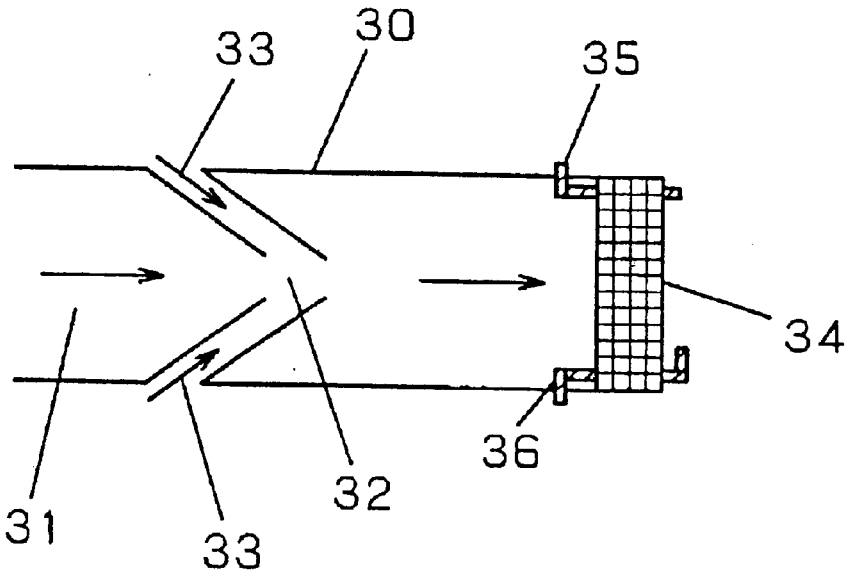
FIG. 5 is block diagram of a burner portion according to the fourth embodiment of the invention.

FIG. 4 shows a refrigeration cycle of a fourth embodiment, and FIG. 5 shows a burner portion. The reference number 20 represents a compressor, 21 represents a 4-way valve, 22 represents a outdoor heat exchanger, 23 represents a dryer, 24 represents an expansion device, 25 represents an indoor heat exchanger, and 26 represents indoor-outdoor connection pipes. The compressor 20, the 4-way valve 21, the outdoor heat exchanger 22, the dryer 23, and the expansion device 24 are built in an outdoor unit. The reference number 27 represents a gas sensor, 28 represents a discharge electric valve, 29 represents a burner portion. The gas sensor 27 is disposed in an indoor unit, and the discharge electric valve 28 is disposed in a connection portion between the outdoor unit and the indoor-outdoor connection pipe 26. The burner portion 29 is disposed adjacent to the discharge electric valve 28. As in the first embodiment, propane is used as a refrigerant, and carbonate compound is charged in the compressor 20 as a refrigerating machine oil. The same dryer as in the first embodiment was used.

The present embodiment has the structure in which the burner portion 29 is added in the second embodiment. Propane to be discharged from the discharge electric valve 28 to the atmosphere passes through a nozzle 32 from a gas flow passage 31 inside a cylindrical body 30 in the burner portion 29, while the propane mixes with a portion of air sucked and introduced from open air introducing portions 33, and the propane mixed with the air is introduced to a flame port 34 where the propane is ignited by an ignition element 35, and is burnt so that the propane is decomposed into carbon dioxide and water, and discharged to the atmosphere. The flame is detected using a flame rod 36 as an attachment. Therefore, the refrigerant can safely be discharged from the air conditioner.

In the present embodiment, a generally called Bunsen burner is used, but the present invention is not limited to this. The burner may be of a complete previously mixing type, or a dispersion type in which the open air is introduced by a fan. However, since a refrigerant which is a fuel is provided for oneself by the internal pressure, it can not be said that the supply state is constant and therefore, it is considered that the Bunsen burner in which a portion of open air is sucked and mixed is most preferable.

Although the indoor unit is provided with the gas sensor in the present embodiment, the present invention is not limited to this. It is also effective to dispose the gas sensor in the outdoor unit. When the indoor-outdoor connection pipes are pipes built into a building, it is effective for improving safety to dispose the gas sensor in the pipe. The gas sensor may not be disposed only in place, and when it seems that a degree of danger is high, a plurality of gas sensors can be disposed.

(Fifth Embodiment)

Figure 6:
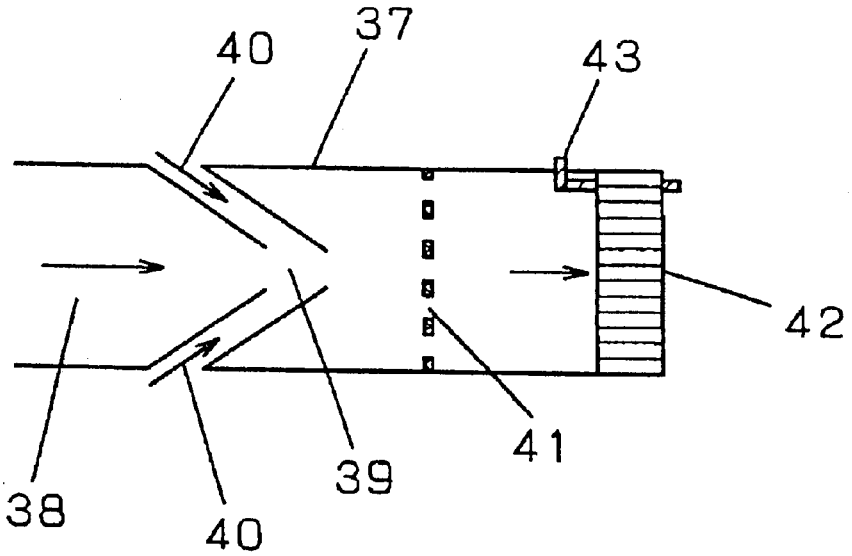
FIG. 6 is block diagram of a burner portion according to the fifth embodiment of the invention.

A fifth embodiment is characterized in that the burner portion in the fourth embodiment is a catalyst burning type, and other portions are the same as those of the fourth embodiment. Therefore, the burner portion will be explained in detail with reference to FIG. 6.

The burner portion is disposed adjacent to the refrigerant discharge electric valve in a cylindrical body 37, and comprises, therein, a gas flow passage 38, a nozzle 39, open air introducing paths 40, a mesh 41, a catalyst 42, and an ignition element 43. A refrigerant to be discharged passes through the refrigerant flow passage 38, and while the refrigerant passes through the nozzle 39 a portion of air from the open air introducing paths 40 is sucked and mixed with the refrigerant, and passes through the mesh 41, and is introduced to the catalyst 42. The ignition element 43 is disposed adjacent to the catalyst 42, and when the refrigerant which has passed through the catalyst 42 is ignited, the refrigerant is first fired at the catalyst and then, within few seconds, the catalyst 42 is heated, and the firing position is moved to the catalyst 42 such that the refrigerant is backfired. Thereafter, the refrigerant is stably burnt in a condition of catalyst combustion manner continuously at the catalyst. The mesh 41 is used for safety when the supply of the refrigerant which is the fuel is unstable and the refrigerant is further backfired. When the refrigerant is backfired, if the refrigerant is supplied again, since the catalyst 42 itself is has a temperature at which the catalyst 42 is sufficiently activated, the catalyst combustion at the catalyst 42 can be continued without again igniting by the ignition element.

In the case of catalyst combustion, the fire does not go out by wind from outside, and even when the supply speed of the refrigerant which is the fuel is unstable, and after fire goes out unlike the flame combustion, it is possible to catch fire to continue the combustion again. Therefore, it is possible to stably and completely burn out the refrigerant to the end. In the case of the catalyst combustion, since the combustion load per space is great, the burner portion can be formed compactly.

In the first to fifth embodiments, the compressor in which the refrigerating machine oil having less mutual solubility with the refrigerant is used. In the case of the refrigerating machine oil having less mutual solubility with the refrigerant, since the refrigerant is not dissolved in the refrigerating machine oil almost at all, it is easy to draw out the refrigerant in the refrigeration cycle and to discharge the refrigerant to the atmosphere, and it is possible to prevent the permanent leakage from the leaking position. In the case of a refrigerating machine oil having great mutual solubility with the refrigerant, even if it is intended to discharge the refrigerant from the discharge valve, since the refrigerant dissolved into the refrigerating machine oil takes time for separating from the refrigerating machine oil, it is difficult to discharge all the amount of refrigerant. However, in order to reduce the amount of leakage, it is considered effective to draw out the refrigerant in the refrigeration cycle immediately after the leakage is detected.

In the case of an oil-free compressor in which a refrigerating machine oil is not charged, it is easy to discharge all the amount of refrigerant as in the embodiments, and it is considered that such a compressor is effective to prevent the permanent leakage.

Figure 7:
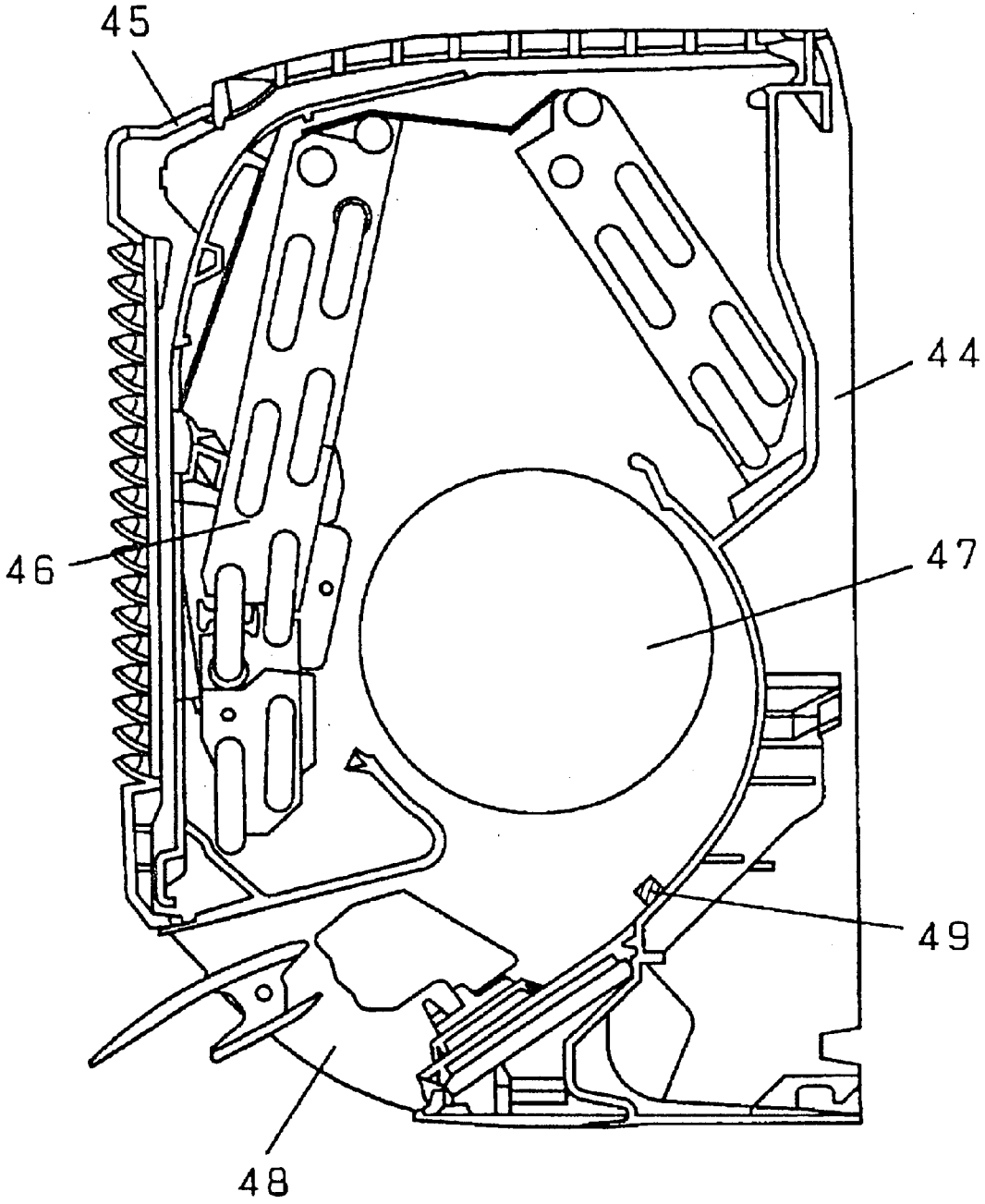
FIG. 7 is a side sectional view of an indoor unit used in the invention.

FIG. 7 is a sectional side view of an indoor unit. In the indoor unit, a heat exchanger 46 and a cross flow fan 47 are disposed in a frame 44 and a front surface grille 45. A ventilation circuit in the indoor unit is formed such that the air sucked by the front surface grille 45 passes through the heat exchanger 46 so that the air is heated or cooled and then, the air is further blown by the cross flow fan 47, and the warm or cool wind is blown into an indoor space from a transfer grille 48. The gas sensor 49 is fixed, e.g., on the frame 44 between the cross flow fan 47 and the transfer grille 48 in the ventilation circuit.

When the refrigerant in the refrigeration cycle leaks from the indoor unit into an indoor space, since the ventilation circuit is provided in the indoor unit, the refrigerant leaks from a copper pipe of the heat exchanger 46. Since the refrigerant is greater in density than air, it is considered that the refrigerant is dispersed downward and is discharged from the transfer grille 48 into the indoor space in many cases. When the air conditioner is operating, since the cross flow fan 47 is rotating of course, the refrigerant is discharged from the transfer grille 48. Therefore, by fixing and disposing the gas sensor 49 on the frame 44 between the cross flow fan 47 and the transfer grille 48, it is possible to detect most refrigerant leaking in the indoor unit.

In the present embodiments, carbonate compound (ratio of 28% carbon forming carbonic acid ester bond) shown in the chemical formula 1 is used as the refrigerating machine oil. In this regard, it was found that in order to suppress the mutual solubility with propane, isobutane or ethane to a small value, it is preferable that in the carbonate compound, the ratio of carbon forming carbonic acid ester bond is 10 atomic % or higher with respect to all the number of carbon forming the carbonate compound. However, if the ratio exceeds 30 atomic %, since the thermal stability as the refrigerating machine oil is largely deteriorated, it is considered that the optimal range of the ratio is 10 to 30 atomic %.

As can be understood from the above explanation, according to the present invention, when a flammable refrigerant leaks, the refrigerant is discharged out to a safe place, i.e., to the atmosphere. Therefore, it is possible to prevent the refrigerant from being accumulated in a dangerous place.

Although the above embodiment has been explained based on the case in which propane is mainly used as the refrigerant, the same effect could be obtained even if a refrigerant comprising, as a main component, one of isobutane and ethane, or a mixture of two or more of propane, isobutane and ethane was used.

What is claimed is:

1. An integral-type air conditioner, in which an indoor unit and an outdoor unit are formed integrally, a refrigeration cycle comprises an indoor heat exchanger, an outdoor heat exchanger, a compressor, and an expansion device which are annularly connected to one another through pipes, and said refrigeration cycle uses a flammable refrigerant as a refrigerant, wherein a gas sensor is provided inside a room, a refrigerant discharge portion is disposed outside said room, said gas sensor monitors leakage of said refrigerant from said refrigeration cycle toward outside, after the leakage is detected by said gas sensor, said discharge portion is opened to discharge said refrigerant outside.

2. An air conditioner, in which a refrigeration cycle comprises an indoor heat exchanger included in an indoor unit, an outdoor heat exchanger included in an outdoor unit, a compressor, and an expansion device which are annularly connected to one another through pipes, said refrigeration cycle uses a flammable refrigerant as a refrigerant, and said indoor unit and said outdoor unit are connected with each other using connection pipes, wherein said refrigeration cycle is provided with a gas sensor and a refrigerant discharge portion, said gas sensor monitors leakage of said refrigerant from said refrigeration cycle toward outside, after the leakage is detected by said gas sensor, said discharge portion is opened to discharge said refrigerant outside.

3. An air conditioner according to claim 2, wherein said indoor unit is provided with said gas sensor, and said outdoor unit or the connection pipes are provided with said refrigerant discharge portion.

4. An integral-type air conditioner, in which an indoor unit and an outdoor unit are formed-integrally, a refrigeration cycle comprises an indoor heat exchanger, an outdoor heat exchanger, a compressor, and an expansion device which are annularly connected to one another through pipes, and said refrigeration cycle uses a flammable refrigerant as a refrigerant, wherein a gas sensor is provided inside a room, a refrigerant discharge portion and a fan are disposed outside said room, said gas sensor monitors leakage of said refrigerant from said refrigeration cycle toward outside, after the leakage is detected by said gas sensor, said discharge portion is opened to discharge said refrigerant outside while rotating said fan.

5. An air conditioner, in which a refrigeration cycle comprises an indoor heat exchanger included in an indoor unit, an outdoor heat exchanger included in an outdoor unit, a compressor, and an expansion device which are annularly connected to one another through pipes, said refrigeration cycle uses a flammable refrigerant as a refrigerant, and said indoor unit and said outdoor unit are connected with each other using connection pipes, wherein a gas sensor, a refrigerant discharge portion and a fan are disposed in said refrigeration cycle, said gas sensor monitors leakage of said refrigerant from said refrigeration cycle toward outside, after the leakage is detected by said gas sensor, said discharge portion is opened to discharge said refrigerant outside while rotating said fan.

6. An air conditioner according to claim 5, wherein said indoor unit is provided with said gas sensor, and said outdoor unit or the connection pipes are provided with said refrigerant discharge portion and said fan.

7. An integral-type air conditioner, in which an indoor unit and an outdoor unit are formed integrally, a refrigeration cycle comprises an indoor heat exchanger, an outdoor heat exchanger, a compressor, and an expansion device which are annularly connected to one another through pipes, and said refrigeration cycle uses a flammable refrigerant as a refrigerant, wherein a gas sensor is provided inside a room, a refrigerant discharge portion and a burner portion are disposed outside said room, said gas sensor monitors leakage of said refrigerant from said refrigeration cycle toward outside, after the leakage is detected by said gas sensor, said discharge portion is opened to discharge said refrigerant outside while burning said refrigerant.

8. An air conditioner, in which a refrigeration cycle comprises-an indoor heat exchanger included in an indoor unit, an outdoor heat exchanger included in an outdoor unit, a compressor, and an expansion device which are annularly connected to one another through pipes, said refrigeration cycle uses a flammable refrigerant as a refrigerant, and said indoor unit and said outdoor unit are connected with each other using connection pipes, wherein said refrigeration cycle is provided with a gas sensor, a refrigerant discharge portion and a burner portion, said gas sensor monitors leakage of said refrigerant from said refrigeration cycle toward outside, after the leakage is detected by said gas sensor, said discharge portion is opened to discharge said refrigerant outside while burning said refrigerant.

9. An air conditioner according to claim 8, wherein said indoor unit is provided with said gas sensor, and said outdoor unit or the connection pipes are provided with said refrigerant discharge portion and said burner portion.

10. An air conditioner according to claim 7 or 9, wherein said flammable refrigerant in said refrigeration cycle and a portion of outside air are previously mixed by a burner portion.

11. An air conditioner according to claim 7 or 9, wherein said flammable refrigerant is burnt by said burner portion in a catalyst combustion manner.

12. An air conditioner according to any one of claims 1 to 9, wherein said flammable refrigerant comprising, as main component, one of propane, isobutane and ethane, or a mixture of a plurality of these components.

13. An air conditioner according to any one of claims 1 to 9, wherein a refrigerating machine oil in said compressor has less mutual solubility with said flammable refrigerant.

14. An air conditioner according to any one of claims 1 to 9, wherein said compressor is an oil-free compressor into which a refrigerating machine oil is not charged.

15. An air conditioner according to any one of claims 1 to 9, wherein said gas sensor is disposed between a ventilation fan and a transfer grille in an indoor unit ventilation circuit.

* * * * *